US005252534A

United States Patent [19]

DePalma et al.

[11] Patent Number: 5,252,534

[45] Date of Patent: Oct. 12, 1993

[54] SLIPPING LAYER OF POLYIMIDE-SILOXANE FOR DYE-DONOR ELEMENT USED IN THERMAL DYE TRANSFER

[75] Inventors: Vito A. DePalma, Rochester; Ravi Sharma, Fairport; Scott E. Tunney, Ontario; David P. Brust, Rochester, all of N.Y.

[73] Assignee: Eastman Kodak Company, Rochester, N.Y.

[21] Appl. No.: 890,457

[22] Filed: May 29, 1992

[51] Int. Cl.[5] ..... B41M 5/035; B41M 5/38

[52] U.S. Cl. ..... 503/227; 428/195; 428/447; 428/913; 428/914

[58] Field of Search ..... 503/227; 428/195, 447, 428/913, 914

[56] References Cited

U.S. PATENT DOCUMENTS 4,910,087 3/1990 Torii et al. ..... 428/423.1

*Primary Examiner*—Pamela R. Schwartz

*Attorney, Agent, or Firm*—Harold E. Cole

[57] ABSTRACT

A dye-donor element for thermal dye transfer comprising a support having on one side thereof a dye layer and on the other side a slipping layer comprising a lubricating material comprising a polyimide-siloxane copolymer, the polysiloxane component comprising more than 3 weight % of the copolymer and the polysiloxane component having a molecular weight of greater than 3900.

19 Claims, No Drawings

SLIPPING LAYER OF POLYIMIDE-SILOXANE FOR DYE-DONOR ELEMENT USED IN THERMAL DYE TRANSFER

This invention relates to dye donor elements used in thermal dye transfer, and more particularly to the use of certain siloxane copolymers on the back side thereof to prevent various printing defects and tearing of the donor element during the printing operation.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method for Controlling A Thermal Printer Apparatus," issued Nov. 4, 1986, the disclosure of which is hereby incorporated by reference.

A problem has existed with the use of dye-donor elements for thermal dye-transfer printing because a thin support is required in order to provide effective heat transfer. For example, when a thin polyester film is employed, it softens when heated during the printing operation and then sticks to the thermal printing head, preventing donor transport. A slipping layer is typically provided to facilitate passage of the dye-donor under the thermal printing head. A defect in the performance of that layer causes intermittent rather than continuous transport across the thermal head. The dye transferred thus does not appear as a uniform area, but rather as a series of alternating light and dark bands (chatter marks).

U.S. Pat. No. 4,910,087 discloses a heat-resistant layer on the back surface of a thermal dye-donor element comprising a polyurethane or polyurea resin modified with polysiloxane blocks. There are a number of problems with this slipping layer including sticking between the dye layer and slipping layer when the donor is rolled up, dye crystallization caused by contact of the dye layer with the slipping layer, and head debris built-up upon processing. It is an object of this invention to eliminate or reduce the above problems.

Accordingly, this invention relates to a dye-donor element for thermal dye transfer comprising a support having on one side thereof a dye layer and on the other side a slipping layer comprising a lubricating material and wherein the lubricating material comprises a polyimide-siloxane copolymer, the polysiloxane component comprising more than 3 weight % of the copolymer and the polysiloxane component having a molecular weight of greater than 3900.

The polyimide-siloxane copolymer employed in the invention can be solvent-coated directly on the support without the need for a subbing layer. The polyimide-siloxanes which are most useful in the practice of the invention are linear and solvent-soluble. By "linear" it is meant that the polyimide-siloxane consists essentially of recurring units containing cyclic imide and siloxane units in the polymer backbone and that such recurring units are present essentially in the form of long chains. By "solvent-soluble" it is meant that the polyimide-siloxane must be at least slightly soluble in organic solvents.

A preferred class of solvent-soluble linear polyimide-siloxanes includes those polyimide-siloxanes derived from a diaminosiloxane and a phenylindane diamine and dianhydride as described in U.S. Pat. No. 3,856,752, the disclosure of which is hereby incorporated by reference. These polyimides are characterized by phenylindane diamines and/or dianhydrides incorporated into the polyimide backbone. In another preferred embodiment, toluene diamine or 2,2'-bis(amino phenyl)-hexafluoropropane can also be used.

Particularly preferred polyimide-siloxanes contain recurring units having the structural formula:

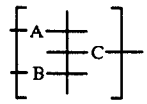

wherein A is selected from a phenylindane radical having the structural formula:

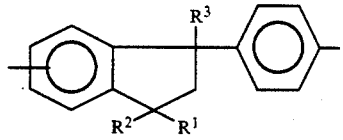

wherein $R^1$, $R^2$, and $R^3$ are individually H or an alkyl group preferably containing from 1 to about 5 carbon atoms; or a group having the structural formula:

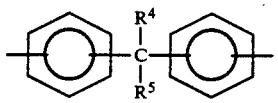

wherein $R^4$ and $R^5$ are individually H, alkyl or fluoroalkyl, the alkyl portion of which preferably contains from 1 to about 5 carbon atoms; or a group having the structural formula:

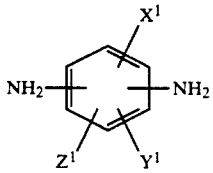

wherein $X^1$, $Y^1$, and $Z^1$ are each independently selected from hydrogen, halogen, alkyl or halogenated alkyl of from 1 to about 12 carbon atoms, or aryl or halogenated aryl of from about 6 to about 12 carbon atoms, provided that all of $X^1$, $Y^1$, and $Z^1$ are not hydrogen;

B has the structural formula:

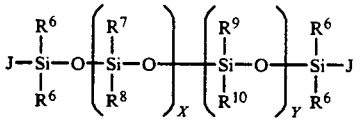

wherein: each J is a linking group independently selected from alkyl and fluoroalkyl groups having up to about 5 carbon atoms, and aryl groups having up to about 12 carbon atoms;

$R^6$, $R^7$, $R^8$, $R^9$, and $R^{10}$ are each individually aryl, alkyl or fluoroalkyl, the alkyl portion of which preferably contains from 1 to 5 carbon atoms; and The values of X and Y are each from 0 to about 400, such that the value of X+Y is from 50 to about 4000; and C can be selected from a group having the structural formula:

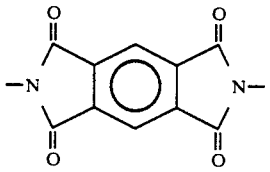

-continued or

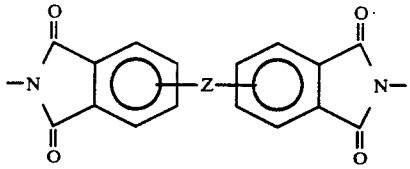

wherein Z is nil

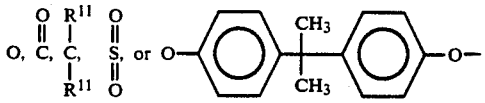

wherein $R^{11}$ is H, alkyl or fluoroalkyl, the alkyl portion of which preferably contains from 1 to about 5 carbon atoms.

In a preferred embodiment of the above formula, both J radicals are the same. When J is an alkyl group, it is preferably $-(CH_2)_3-$ or $-(CH_2)_4-$. When J is an aryl group, it may be a phenyl radical, an alkyl-substituted phenyl radical, or a naphthyl radical.

Representative species of highly preferred polyimide-siloxanes which have been found to be useful in the practice of this invention include

E-1

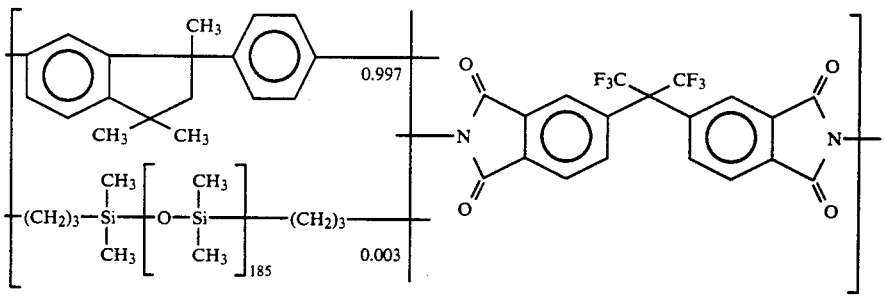

E-2

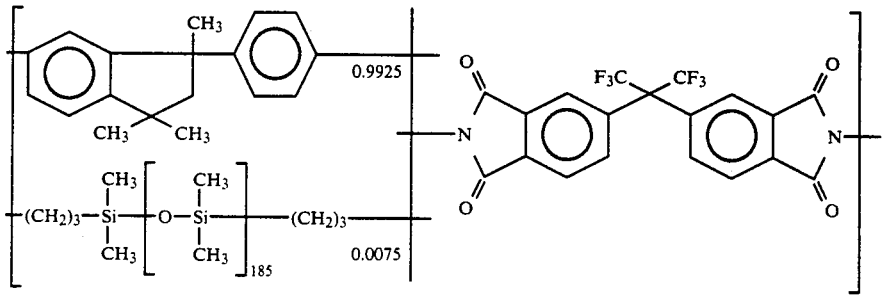

-continued
E-3
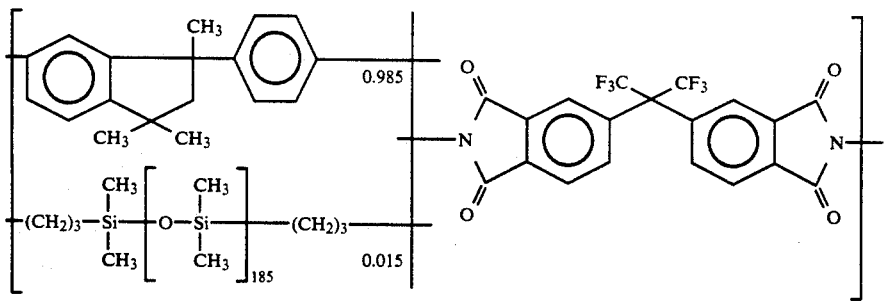
E-4
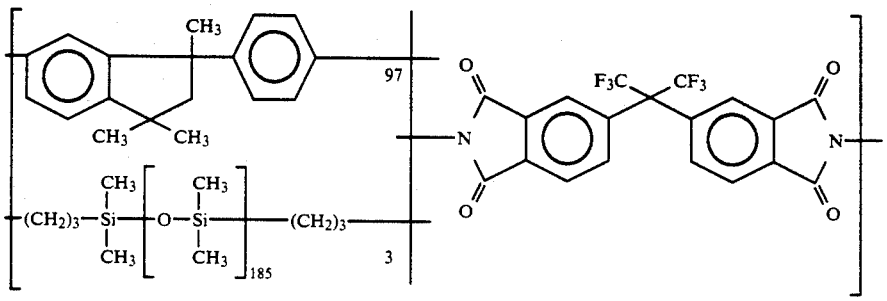
E-5
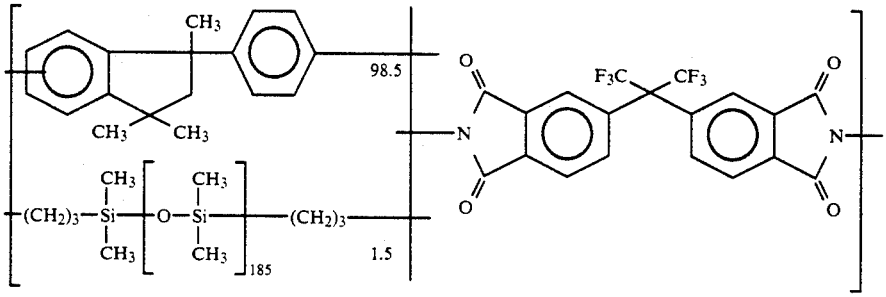
E-6
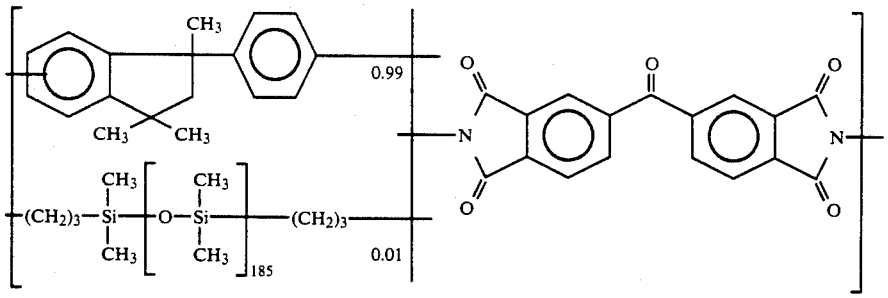
E-7
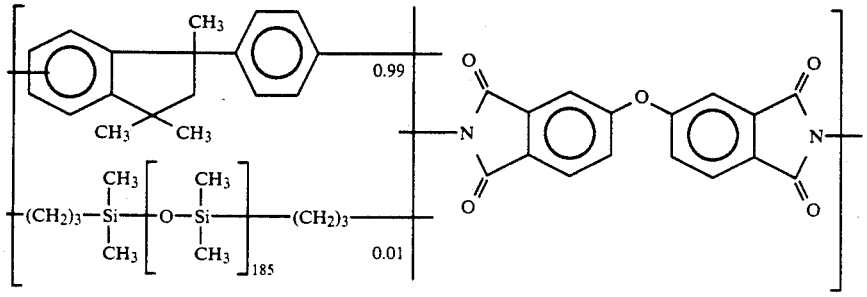

-continued

E-8

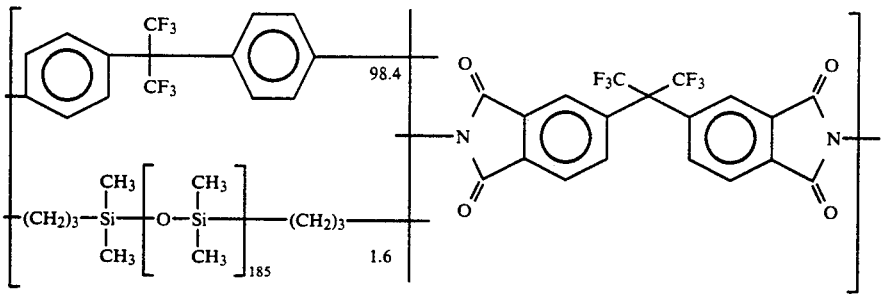

E-9

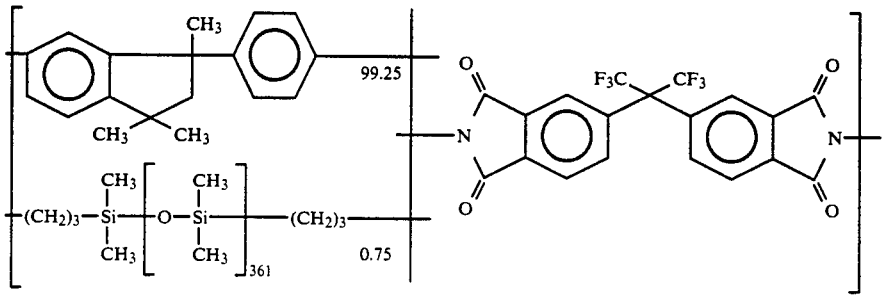

E-10

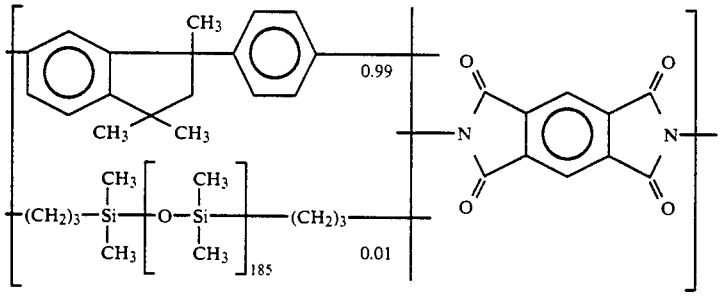

E-11

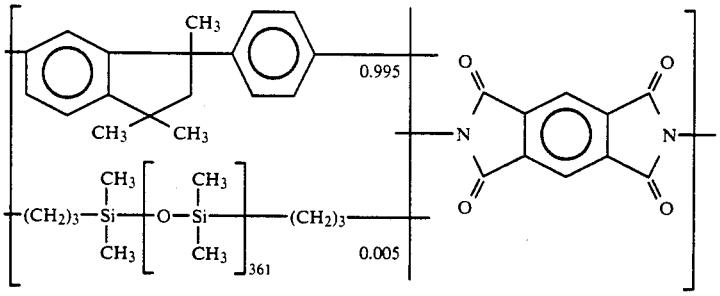

E-12: is similar to E-7 but with a ratio of 90:10.

It is believed that linear polyimide-siloxanes useful in the practice of this invention can be derived from a variety of diamines and dianhydrides. The diamines that can be employed in the preparation of the polyimide-siloxanes useful herein include the phenylindane diamines described in U.S. Pat. No. 3,856,752, examples of which include:

5-amino-1-(4'-aminophenyl)-1,3,3-trimethylindane;
6-amino-1-(4'-aminophenyl)-1,3,3-trimethylindane,
optionally substituted with alkyl, halogen or fluoroalkyl, and aromatic diamines, for example,
4,4'-methylenebis(o-chloroaniline),
3,3'-dichlorobenzidine,
3,3'-sulfonyldianiline,
4,4'-diaminobenzophenone,
1,5-diaminonaphthalene,
bis(4-aminophenyl)diethyl silane,
bis(4-aminophenyl)diphenyl silane,
bis(4-aminophenyl)ethyl phosphine oxide,
N-(bis(4-aminophenyl))N-methyl amine,
N-(bis(4-aminophenyl))N-phenyl amine,
4,4-methylenebis(2-methylaniline),
4,4'-methylenebis(2-methoxyaniline),
5,5'-methylenebis(2-aminophenol),
4,4'-methylenebis(2-methylaniline),
4,4'-oxybis(2-methoxyaniline),
4,4'-oxybis(2-chloroaniline),
2,2'-bis(4-aminophenol),
5,5'-oxybis(2-aminophenol),
4,4'-thiobis(2-methylaniline),
4,4'-thiobis(2-methoxyaniline),
4,4'-thiobis(2-chloroaniline),
4,4'-sulfonylbis(2-methylaniline), 4,4'-sulfonylbis(2-ethoxyaniline),
4,4-sulfonylbis(2-chloroaniline),
5,5'-sulfonylbis(2-aminophenol),
3,3-dimethyl-4,4'-diaminobenzophenone,
3,3'-dimethoxy-4,4'-diaminobenzophenone,
3,3-dichloro-4,4'-diaminobenzophenone,
4,4'-diaminobiphenyl,
m-phenylenediamine,
p-phenylenediamine,
4,4'-methylenedianiline,
4,4'-oxydianiline,
4,4'-thiodianiline,
4,4'-sulfonyldianiline,
4,4'-isopropylidenedianiline,
3,3-dimethylbenzidine,
3,3'-dimethoxybenzidine,
3,3'-dicarboxybenzidine,
2,4-tolyldiamine,
2,5-tolyldiamine,
2,6-tolyldiamine,
m-xylyldiamine,
2,4-diamino-5-chloro-toluene, and
2,4-diamino-6-chloro-toluene.

Aromatic polyimide-siloxanes for this invention can also be made from the benzhydrols disclosed in U.S. Pat. No. 4,736,015.

The difunctional siloxane monomers employed in the invention can be diamino- or dianhydride-terminated. In general, the employment of the $\alpha,\omega$-diaminosiloxane and $\alpha,\omega$-dianhydridesiloxane are interchangeable in the invention. Siloxanediamines for the preparation of polyimide-siloxanes for this invention can be selected from appropriate materials in U.S. Pat. No. 4,499,149.

Dianhydrides that can be employed in the preparation of the polyimide-siloxanes believed to be useful herein include the dianhydrides described in U.S. Pat. No. 3,856,752, examples of which include phenylindane dianhydrides, such as 1-(3',4'-dicarboxyphenyl)-1,3,3-trimethylindan-5,6-dicarboxylic acid dianhydride,
1-(3',4'-dicarboxyphenyl)-1,3,3-trimethylindan-6,7-dicarboxylic acid dianhydride,
1-(3',4'-dicarboxyphenyl)-3-methylindan-5,6-dicarboxylic acid dianhydride,
1-(3.,4'-dicarboxyphenyl)-3-methylindan-6,7-dicarboxylic acid dianhydride, and other dianhydrides, preferably aromatic dianhydrides or tetracarboxylic acid dianhydrides, such as
2,3,9,10-perylenetetracarboxylic acid dianhydride,
1,4,5,8-naphthalenetetracarboxylic acid dianhydride,
2,6-dichloronaphthalene-1,4,5,8-tetracarboxylic acid dianhydride,
2,7-dichloronaphthalene-1,4,5,8-tetracarboxylic acid dianhydride,
2,3,6,7-tetrachloronaphthalene-1,4,5,8-tetracarboxylic acid dianhydride,
phenanthrene-1,8,9,10-tetracarboxylic acid dianhydride,
2,3,3',4-benzophenonetetracarboxylic acid dianhydride,
pyromellitic dianhydride,
3,3',4'4'-benzophenonetetracarboxylic acid dianhydride,
2,2,3,3-benzophenonetetracarboxylic acid dianhydride,
3,3,4,4'-biphenyltetracarboxylic acid dianhydride,
2,2,3,3'-biphenyltetracarboxylic acid dianhydride,
4,4'-isopropylidenediphthalic anhydride,
3,3-isopropylidenediphthalic anhydride,
4,4'-oxydiphthalic anhydride,
4,4'-sulfonyldiphthalic anhydride,
3,3'-oxydiphthalic anhydride,
4,4'-methylenediphthalic anhydride,
4,4'-thiodiphthalic anhydride,
4,4'-ethylidenediphthalic anhydride,
2,3,6,7-naphthalenetetracarboxylic acid dianhydride,
1,2,4,5-naphthalenetetracarboxylic acid dianhydride,
1,2,5,6-naphthalenetetracarboxylic acid dianhydride,
benzene-1,2,3,4-tetracarboxylic acid dianhydride,
pyrazine-2,3,5,6-tetracarboxylic acid dianhydride and
thiophene-2,3,4,5-tetracarboxylic acid dianhydride.

The diamines, difunctionalsiloxanes and dianhydrides described above are known compounds and/or can be prepared by one skilled in the art by known procedures.

The above solvent-soluble polyimide-siloxanes useful in the practice of this invention are known and/or can be prepared by techniques well known to those skilled in the art. For example, the polyimidesiloxanes can be prepared by reacting the diamines with dianhydrides in an organic reaction medium such as described in U.S. Pat. No. 3,856,752 cited above to form a polyamic acid which is subsequently converted to the polyimide by known techniques, for example, by chemical and/or thermal methods. An illustrative preparation is set forth below. Polyimide-siloxanes useful herein can also be prepared by reacting a diisocyanate with a dianhydride, such as described in U.S. Pat. No. 3,708,458.

The polyimide-siloxanes were prepared by addition of an equimolar amount of dianhydride to a solution of the diamine in tetrahydrofuran (THF) and/or N-dimethylformamide (DMF) at room temperature. The reaction mixture was heated briefly to 60° C., then stirred at room temperature for 4–8 hours. To this solution, 3.5 molar equivalents of pyridine and 4.0 molar equivalents of acetic anhydride were added and the reaction was then stirred overnight. The solution was precipitated from isopropanol and/or methanol; the polymer was isolated by vacuum filtration, washed with isopropanol and/or methanol and dried under vacuum at 100° C. overnight. The polyimide-siloxane was redissolved, reprecipitated from isopropanol and/or methanol, and dried under vacuum at 100° C. overnight.

The following materials employed in the invention along with several comparison copolymers were prepared for the tests described below:

E-1: This polyimide-siloxane was prepared from 10.624 g (39.880 mmol) of 5-amino-(4-aminophenyl)-1,1,3-trimethylindane, 1.680 g (0.1200 mmol) of aminopropyl-terminated dimethylsiloxane oligomer of 14,000 molecular weight, and 17.770 g (40.000 mmol) of 2,2-bis(4-phthalic anhydride)-hexafluoroisopropylidene in 150 ml of THF, imidized with 11.1 g (140 mmol) of pyridine and 16.3 g (160 mmol) of acetic anhydride yielding 26.7 g (93%) of the desired product.

E-2: This polimide-siloxane was prepared from 10.576 g (39.700 mmol) of 5-amino-(4-aminophenyl)-1,1,3-trimethylindane, 4.200 g (0.3000 mmol) of aminopropyl-terminated dimethylsiloxane oligomer of 14,000 molecular weight, and 17.770 g (40.000 mmol) of 2,2-bis(4-phthalic anhydride)-hexafluoroisopropylidene in 150 ml of THF, imidized with 11.1 g (140 mmol) of pyridine and 16.3 g (160 mmol) of acetic anhyride yielding 28.5 g (92%) of the desired product. from 133.19 g (500.13 mmol) of 5-amino-(4-aminophenyl)-1,1,3-trimethylidane, 106.6 g (7.616 mmol) of aminopropyl-terminated dimethylsiloxane oligomer of 14,000 molecular weight, and 225.5 g (507.75 mmol) of 2,2-bis(4-phthalic anhydride)-hexafluoroisopropylidene in 2000 ml of THF, imidized with 140.6 g (1.777 mol) of pyridine and 207.3 g (2.031 mol) of acetic anhydride yielding 385 g (86%) of the desired product.

E-4 This polyimide-siloxane was prepared from 12.920 g (48.505 mmol) of 5-amino-(4-aminophenyl)-1,1,3-trimethylindane, 21.002 g (1.5001 mmol) of aminopropyl-terminated dimethylsiloxane oligomer of 14,000 molecular weight and 22.214 g (50.004 mmol) of 2,2-bis(4-phthalic anhydride)-hexafluoroisopropylidene in 245 ml of THF, imidized with 13.8 g (175 mmol) of pyridine and 20.4 g (200 mmol) of acetic anhydride yielding 42 g (77%) of the desired product.

E-5: This polyimide-siloxane was prepared from 15.332 g (57.552 mmol) of 5(6)-amino-(4-aminophenyl)-1,1,3-trimethylindane, 12.270 g (0.87643 mmol) of aminopropyl-terminated dimethylsiloxane oligomer of 14,000 molecular weight, and 25.956 g (58.429 mmol) of 2,2-bis(4-phthalic anhydride)hexafluoroisopropylidene in 235 ml of THF, imidized with 16.1 g (205 mmol) of pyridine and 234 g (238 mmol) of acetic anhydride yielding 44.5 g (87%) of the desired product.

E-6: This polyimide-siloxane was prepared from 13.378 g (50.220 mmol) of 5(6)-amino-(4-aminophenyl)-1,1,3-trimethylindane, 7.102 g (0.5073 mmol) of aminopropyl-terminated dimethylsiloxane oligomer of 14,000 molecular weight, and 16.347 g (50.729 mmol) of 3,3',4,'-benzophenonetetracarboxylic dianhydride in 160 ml of THF, imidized with 14.0 g (178 mmol) of pridine and 20.7 g (203 mmol) of acetic anhydride yielding 32.0 g (91%) of the desired product.

E-7: This polyimide-siloxane was prepared from 13.338 g (50.073 mmol) of 5(6)-amino-(4-aminophenyl)-1,1,3-trimethylindane, 7.081 g (0.5058 mmol) of aminopropyl-terminated dimethylsiloxane oligomer of 14,000 molecular weight, and 15.690 g (50.579 mmol) of 4,4'-oxydiphthalic anhydride in 160 ml of THF, imidized with 14.0 g (177 mmol) of pyridine and 20.7 g (202 mmol) of acetic anhydride yielding 32.9 g (96%) of the desired product.

E-8: This polyimide-siloxane was prepared from 16.710 g (49.990 mmol) of 2,2'-bis(4-aminophenyl)-hexafluoropropane, 11.380 g (0.8129 mmol) of aminopropyl-terminated dimethylsiloxane oligomer of 14,000 molecular weight, and 22.567 g (50.803 mmol) of 2,2-bis(4-phthalic anhydride)-hexafluoroisopropylidene in 220 ml of THF, imidized with 14.0 g (178 mmol) of pyridine and 20.7 g (203 mmol) of acetic anhydride yielding 40.0 g (82%) of the desired product.

E-9 This polyimide-siloxane was prepared from 13.960 g (52.404 mmol) of 5-amino-(4-aminophenyl)-1,1,3-trimethylindane, 10.693 g (0.3960 mmol) of aminopropyl-terminated dimethylsiloxane oligomer of 27,000 molecular weight, and 23.450 g (52.800 mmol) of 2,2-bis(4-phthalic anhydride)-hexafluoroisopropylidene in 200 ml of THF, imidized with 14.6 g (185 mmol) of pyridine and 21.5 g (211 mmol) of acetic anhydride yielding 39.4 g (85%) of the desired product.

E-10: This polyimide-siloxane was prepared from 6.593 g (24.75 mmol) of 5-amino-(4-aminophenyl)-1,1,3-trimethylindane, 3.500 g (0.2500 mmol) of aminopropylterminated dimethylsiloxane oligomer of 14,000 molecular weight and 5.453 g (25.000 mmol) of pyromellitic dianhydride (PMDA) in 66 ml of THF, imidized with 6.92 g (87.5 mmol) of pyridine and 10.2 g (100 mmol) of acetic anhydride yielding of the desired product.

E-11: This polyimide-siloxane was prepared from 13.253 g (49.750 mmol) of 5-amino-(4-aminophenyl)-1,1,3-trimethylindane, 6.750 g (0.2500 mmol) of aminopropyl-terminated dimethylsiloxane oligomer of 27,000 molecular weight, and 10.906 g (50.000 mmol) of pyromellitic dianhydride (RMDA) in 131 ml of THF, imidized with 13.8 g (175 mmol) of pyridine and 20.4 g (200 mmol) of acetic anhydride yielding 27.1 g (93%) of the desired product.

E-12: This polyimide-siloxane was prepared from 12.001 g (45.051 mmol) of 5-amino-(4-aminophenyl)-1,1,3-trimethylindane, 70.080 g (5.006 mmol) of aminopropyl-terminated dimethylsiloxane oligomer of 14,000 molecular weight, and 22.237 g (50.134 mmol) of 2,2-bis(4-phthalic anhydride)-hexafluoroisopropylidene in 460 ml of THF, imidized with 13.8 g (175 mmol) of pyridine and 20.4 g (200 mmol) of acetic anhydride yielding 92.0 g (90%) of the desired product.

C-1: This polyimide-siloxane was prepared from 26.598 g (99.850 mmol) of 5-amino-(4-aminophenyl)-1,1,3-trimethylindane, 2.100 g (0.1500 mmol) of aminopropyl-terminated dimethylsiloxane oligomer of 14,000 molecular weight, and 44.424 g (100.00 mmol) of 2,2-bis(4-phthalic anhydride)-hexafluoroisopropylidene in 320 ml of THF, imidized with 27.6 g (350 mmol) of pyridine and 40.8 g (400 mmol) of acetic anhydride yielding 60.9 g (88%) of the desired product.

C-2 This polyimide-siloxane was prepared from 18.236 g (68.460 mmol) of 5-amino-(4-aminophenyl)-1,1,3-trimethylindane, 13.877 g (5.5508 mmol) of aminopropyl-terminated dimethylsiloxane oligomer of 2500 molecular weight, and 32.878 g (74.011 mmol) of 2,2-bis(4-phthalic anhydride)-hexafluoroisopropylidene in 280 ml of THF, imidized with 20.4 g 259 mmol) of pyridine and 30.2 g (296 mmol) of acetic anhydride yielding 53.8 g (86%) of desired product.

C-3 This polyimide-siloxane was prepared from 12.653 g (47.500 mmol of 5-amino-(4-aminophenyl)-1,1,3-trimethylidane, 6.250 g (2.500 mmol) of aminopropyl-terminated dimethylsiloxane oligomer of 2500 molecular weight, and 10.906 g (50.000 mmol) of pyromellitic dianhydride (PMDA) in 126 ml of THF, imidized with 13.8 g (175 mmol) of pyridine and 20.4 g (200 mmol) of acetic anhydride yielding 25.2 g (90%) of the desired product.

C-4: This polyimide-siloxane was prepared from 5.641 g (21.18 mmol) of 5-amino-(4-aminop 1,3-trimethylindane, 280 g (1.115 mmol) of aminopropylterminated dimethylsiloxane oligomer of 3800 molecular weight, and 9.903 g (22.29 mmol) of 2.2-bis(4-phthalic anhydride)-hexafluoroisopropylidene in 85 ml of THF, imidized with 6.2 g (78 mmol) of pyridine and 9.1 g (89 mmol) of acetic anhydride yielding 17.0 g (89%) of the desired product.

The siloxane copolymer defined above can be employed in the invention herein at any concentration useful for the intended purpose. In general, good results have been obtained at a concentration of about 0.05 to about 1.0 g/m$^2$, preferably about 0.3 to about 0.6 g/m$^2$, with or without a binder.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (Sumitomo Chemical Co., Ltd.), Dianix Fast Violet 3R FS ® (Mitsubishi Chemical Industries, Ltd.), and Kayalon Polyol Brilliant Blue N BGM ® and KST Black 146 ® (Nippon Kayaku Co., Ltd.); azo dyes such as Kayalon Polyol Brilliant Blue BM ®, Kayalon Polyol Dark Blue 2BM ®, and KST Black KR ® (Nippon Kayaku Co., Ltd.), Sumickaron Diazo Black 5G ® (Sumitomo Chemical Co., Ltd.), and Miktazol Black 5GH ® (Mitsui Toatsu Chemicals, Inc.); direct dyes such as Direct Dark Green B ® (Mitsubishi Chemical Industries, Ltd.) and Direct Brown M ® and Direct Fast Black D ® (Nippon Kayaku Co. Ltd.); acid dyes such as Kayanol Milling Cyanine 5R ® (Nippon Kayaku Co. Ltd.); basic dyes such as Sumicacryl Blue 6G ® (Sumitomo Chemical Co., Ltd.), and Aizen Malachite Green ® (Hodogaya Chemical.Co., Ltd.);

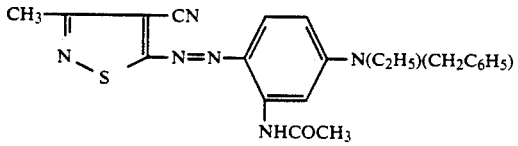

(magenta)

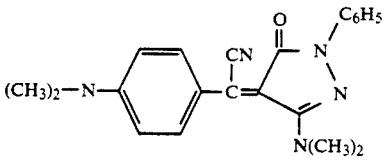

(magenta)

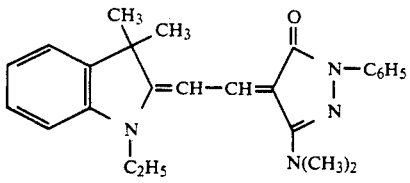

(yellow)

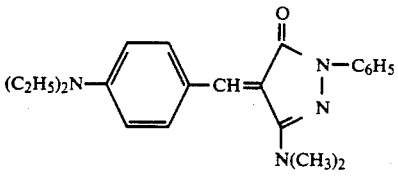

(yellow)

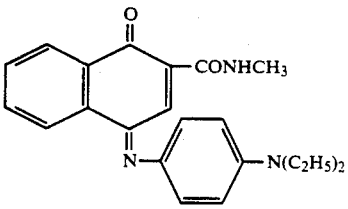

(cyan)

-continued

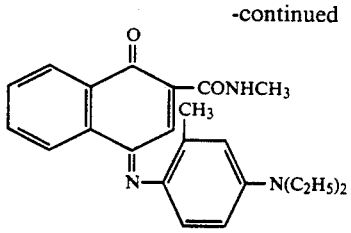

(cyan)

or any of the dyes disclosed in U.S. Pat. No. 5,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer nay be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide amides and polyetherimides. The support generally has a thickness of from about 2 to about 30 μm. It may also be coated with a subbing layer, if desired, such as those materials described in U.S. Pat. No. 4,695,288 or U.S. Pat. No. 4,737,486.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek ®.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$ As noted above, the dye donor elements of the invention are used to form a dye transfer image. Such a process comprises imagewise heating a dye-donor element as described above and transferring a dye image to a dye receiving element to form the dye transfer image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner.

The following examples are provided to illustrate the invention.

Example 1

A multicolor dye-donor set 1 was prepared by gravure coating on a 6 μm poly(ethylene terephthalate) support:

(1) a subbing layer of titanium alkoxide (DuPont Tyzor TBT) ® (0.13 g/m$^2$) from n-propyl acetate and n-butyl alcohol mixture, and (2) a dye layer containing the first yellow dye illustrated above (0.26 g/m$^2$) and Shamrock S363 N-1 polypropylene wax micronized powder (Shamrock Chemicals Corporation) (0.021 g/m$^2$) in a cellulose acetate propionate (2.5% acetyl, 45% propionyl) binder (0.26 g/m$^2$) coated from a toluene, methanol, cyclopentanone solvent mixture.

(3) a dye layer containing the magenta dyes illustrated above (0.18 and 0.17 g/m2 respectively), FLUORAD FC 430 (3M Corporation) (0.002 g/m$^2$) and Shamrock S363 N-1 (0.21 g/m$^2$) in a cellulose acetate propionate (2.5% acetyl, 45% propionyl) binder (0.26 g/m$^2$) coated from the same solvent mixture as for the yellow dyes.

(4) a dye layer containing the cyan dyes illustrated above (0.41 and 0.13 g/m2 respectively), 3M Corporation FLUORAD FC-430 ® (0.002 g/m$^2$) and Shamrock Chemicals Corporation S363 N-1 ® (0.21 g/m$^2$) in cellulose acetate propionate (2.5% acetyl, 45% propionyl) binder as above (0.36 g/m$^2$) coated from the same solvent mixture as for the yellow dye above.

A multicolor dye-donor set 2 was prepared by gravure coating on a 6 μm poly(ethylene terephthalate) support:

(1) a subbing layer of titanium alkoxide (DuPont TYZOR TBT) ® (0.13 g/m$^2$) from n-propyl acetate and n-butyl alcohol mixture, and (2) a dye layer containing the first yellow dye illustrated above (0.20 g/m$^2$), and Fluo HT (Micro Powders Inc.) (0.021 g/m$^2$) in a cellulose acetate propionate binder (0.66 g/m$^2$) coated from a toluene, methanol, cyclopentanone solvent mixture.

(3) a dye layer containing the first magenta dye illustrated above (0.29 g/m$^2$), and Fluo HT (Micro Powders Inc.) (0.021 g/m$^2$) in a cellulose acetate propionate binder (0.47 g/m$^2$) coated from a toluene, methanol, cyclopentanone solvent mixture, (4) a dye layer containing the first cyan dye illustrated above (0.42 g/m$^2$), and Fluo HT (Micro Powders Inc.) (0.021 g/m$^2$) in a cellulose acetate propionate binder (0.66 g/m$^2$) coated from a toluene, methanol, cyclopentanone solvent mixture.

On the back side of the dye-donor set 1 was coated:

(1) a slipping layer of E-3 in ethyl acetate at 1.11% solids. The solution was coated at both 0.32 and 0.54 g/m$^2$ with an extrusion hopper on the backside of the thermal imaging dye donor described above. The coating was made 14 cm wide on a 15 cm slit at 9.1 m/min with the initial drier at 54.4° C. and the later driers at 82° C. These coatings are referred to below as Invention 1*a* and 1*b*, respectively.

(2) for comparison, a slipping layer based on the polyurea-b-PDMS described in Example 2 of U.S. Pat. No. 4,910,087 was made by the reaction of poly(dimethylsiloxanediamine) (molecular weight=1700) with a hydrogenated 4,4'-methylene-bis-phenylisocyanate in 2-butanone and dimethylformamide. The solution was diluted to 3.04% solids with a mixture of 2-butanone (88%) and dimethyl- formamide (12%) and coated at 0.32 g/m$^2$ A 3.38% solution was also coated at 0.54 g/m$^2$ The solution was coated from an extrusion hopper onto dye-donor set 1 as used for Invention la and lb above; however, drying was increased so that all drying sections of the machine were at 180° F. (82° C.). These coatings are referred to below as Comparisons 1 and 2, respectively.

A dye-receiving element was prepared by coating the following layers in the order recited on a titanium dioxide-pigmented polyethylene-overcoated paper stock which was subbed with a layer of poly(acrylonitrile-co-vinylidene chloride-co-acrylic acid) (14:79:7 wt. ratio) (0.08 g/m$^2$) coated from 2-butanone:

(1) Dye-receiving layer of Makrolon 5700 ® (Bayer AG Corporation) polycarbonate resin (2.9 g/m$^2$), Tone PCL-300 ® polycaprolactone (Union Carbide) (0.38 g/m$^2$), and 1,4-didecoxy-2,6-dimethoxyphenol (0.38 g/m$^2$) coated from methylene chloride; and (2) Overcoat layer of Tone PCL-300 ® polycaprolactone (Union Carbide) (0.11 g/m$^2$), FC-431 ® surfactant (3M Corp.) (0.11 g/m$^2$) and DC-510 ® surfactant (Dow Corning) (0.11 g/m$^2$) coated from methylene chloride.

Test for force needed to transport donor/receiver combination under thermal printhead: The dye side of the above dye donor set 1 element strip approximately 10cm×13cm in area was placed in contact with the dye receiving layer of the same area. This assembly was clamped to a stepper motor driving a 60mm-diameter rubber roller. Next, a TDK Thermal head (No. L-231) (thermostatted at 24.5° C.) was pressed against the dye side of the assembly with a force of 36 Newtons (8 pounds) pushing it against the rubber roller.

The imaging electronics were activated causing the donor/receiver assemblage to be drawn between the printhead and roller at 6.9 mm/sec. Coincidentally, the resistive elements in the thermal printhead were pulsed for 29 microsec/pulse at 128 microsec intervals during the 33 microsec/dot printing time. A stepped density image was generated incrementally increasing the number of pulses/dot from 0 to 255. The voltage supplied to the printhead was approximately 24.5 volts, resulting in an instantaneous peak power of 1.4 watts/dot and a maximum total energy of 10.3 mjoules/dot.

As each "area test pattern" of given density was being generated, the torque required to draw the assemblage between the printhead and roller was measured with a Himmelstein Corp. 3-308TL (16-1) Torquemeter ® (1.09 meter-Newton range) and 6-201 Conditioning module. ® Data were taken at steps 0, 2 and 8 (minimum, low and maximum densities). the results on the forces required to pull the donor/receiver combination under the thermal print head are shown in Table 1. These data were obtained after sample incubation at 50° C./50% RH for 2 weeks.

TABLE 1

Force needed to pull the donor/receiver combination under the thermal printhead (Newtons)

| Slipping Layer | g/m$^2$ | Step 0 | Step 2 | Step 8 | Pop* |
|---|---|---|---|---|---|
| Invention 1a | 0.32 | 4.6 | 4.6 | 6.4 | 2.7 |
| Invention 1b | 0.54 | 4.4 | 4.2 | 5.9 | 2.7 |
| Comparison 1 | 0.32 | 9.8 | 5.7 | 4.8 | 15.3 |
| Comparsion 2 | 0.54 | 12.1 | 6.2 | 4.8 | 17.5 |

*The pop value is the difference between the total displacement force in Newtons and the force at step 0.

The above results indicate that the use of the polyimide-siloxane copolymers of this invention as a slipping layer gave results which require much lower forces than do Comparison 1 and 2 which utilize a different siloxane oligomer.

Sticking and Cyan Dye Layer Stability

Cyan dye-donor set 1 with the slipping layers as described was evaluated after the donors had been wrapped n a 1.9 cm diameter wooden spool and incubated for 2 weeks at 50° C./50% RH. After this time, it was observed that sticking took place between the donor and slip layer side of the donor and also that there was an effect of the slip layer on the cyan dye stability on the donor. Sticking was recorded as "none" or "severe". The cyan dye layer stability was measured by reading the red transmission density of the cyan patch where the slip layer was coated. This red density was subtracted from the red transmission density of the cyan present on the edge of the coating not in contact with the slip layer. (The slip layer had been coated narrower than the cyan dye layer). these results are shown in Table 2:

TABLE 2

Incubation of Slip Layers on a Wooden Roll for 2 Weeks at 50° C./50% RH

| COATING | STICKING IN THE ROLL | CYAN DYE DENSITY CHANGE |
|---|---|---|
| Invention 1a | none | 0.0 |
| Invention 1b | none | −0.10 |
| Comparison 1 | severe | −1.47 |
| Comparsion 2 | severe | −1.46 |

Comparisons 1 and 2 showed severe sticking in the roll. Also, the above data for the cyan Dye Density Change indicate that the polyimide-siloxane slipping layers of Inventions 1*a* and 1*b* gave results which are better compared to those of comparisons 1 and 2 which utilize a different polysiloxane copolymer.

Dye Crystallization Induced by Slipping Layer

The dye-donor set 1 coatings were also microscopically examined after incubation for 2 weeks at 50V]C./50% RH for dye crystals on the dye layer surface. The coatings with slip layers made with the polyurea-b-polydimethylsiloxane comparison in Example 2 of U.S. Pat. No. 4,910,087 showed many crystals and severe crystallization due to dye crystal formation in the magenta and cyan dye layers of Comparisons 1 and 2, respectively. The same dye layers when not in contact with these slip layers showed no crystals. Inventions 1*a* and 1*b* which feature the slip layer which utilized a different siloxane copolymer showed a few cyan crystals and no magenta crystals. These results are shown in Table 3:

TABLE 3

Number of Crystals and Dye Crystallization Induced by Slip Layer After 2 Weeks at 50° C./50% RH

| COATING | MAGENTA LAYER | CYAN LAYER |
|---|---|---|
| Invention 1a | none | a few |
| Invention 1b | none | a few |
| Comparison 1 | many | many |
| Comparsion 2 | severe | severe |

Under these incubation conditions, Inventions 1*a* and 1*b* were clearly superior or lack dye crystallization, unlike comparisons 1 and 2.

Head Debris

In this measurement, a pin on disk friction apparatus was used similar to the one described in FIG. 2 of "Friction and wear of self-assembled trichlorosilane monolayer films on silicon", V. DePalma and N. Tillman, Langmuir, 5,868, 1989. This apparatus utilizes a glass ball to simulate the thermal printhead, matching the surface characteristics of the thermal printhead as both glass ball and print head are very smooth and both have an oxide surface which contacts the slipping layer. The glass ball in this apparatus can be heated up to 300° C. so it can simulate the temperature requirements of the thermal printhead. The load between the glass ball and the slipping layer is applied by a set of weights equal to 90 grams. The slipping layer side of the donor is mounted on a disk as shown in the above reference and slowly turned under the glass ball. In a typical experiment, the glass ball is cleaned and the donor is mounted on the disk. Then with the glass ball at 200° C. (controlled with an Omega proportional controller) placed on the slipping layer side, the disk is rotated at a controlled speed of 0.007 m/sec (using an Electro-Craft Corp. #E586-M motor controller). After 30 seconds, the glass ball sliding on the slipping layer side of the donor is removed and the amount of wear debris on it is noted as: "none", "minimal" or "severe", using an optical microscope at a magnification of 200x.

The results of these wear debris tests are recorded in Table 4 for the slipping layers described in Inventions 1*a* and 1*b* and for the Comparisons 1 and 2 made according to Example 2 of U.S. Pat. No. 4,910,087.

TABLE 4

Wear Debris on Glass Ball at 200° C. after 30 Seconds of Sliding a Slipping Layer.

| COATING | WEAR DEBRIS |
|---|---|
| Invention 1a | none |
| Invention 1b | none |
| Comparison 1 | severe |
| Comparsion 2 | severe |

In all cases the amount of wear debris on the glass ball which slid on the slipping layer in Comparisons 1*a* and 2*b* from Example 2 of U.S. Pat. No. 4,910,087 was significantly more severe than that from Inventions 1*a* and 1*b*. where no wear debris could be observed.

Force measurements as outlined in Example 1 were repeated except that dye-donor set 2 and the above dye-receiver were used. On the backside of the dye-donor set 2 were coated the slipping layers listed in table 5. The solutions for these coatings contained 1.0% solids in THF or ethyl acetate, (EA) as indicated. These solutions were coated at 0.32 g/m$^2$ at 14 cm wide on a 15 cm slit of dye donor at 2.86m/min within a class 100 clean air hood at room temperature. The coatings were aged at room temperature for 14 days before they were tested in the imaging device described above using the dye-receiving element discussed earlier. The coating performance as a slipping layer was given a pass (P) or fail (F) rating depending on whether the force in the pops region was less than 4.5 Newtons (for a pass) or above 4.5 Newtons (for a fail). These results are summarized below for 13 different examples.

TABLE 5

Force Needed to Pull Donor/Receiver Combination under the Thermal Printhead (Force given in Newtons)

| Sample | Solvent | g/m$^2$ | Step 0 | Step 2 | Step 8 | Pops | P/F |
|---|---|---|---|---|---|---|---|
| C-1 | THF* | 0.32 | 16.8 | 16.3 | 12.3 | 15.8 | F |
| C-2 | EA* | 0.32 | 16.9 | 16.6 | 12.6 | 15.7 | F |
| C-3 | EA | 0.32 | 15.0 | 11.4 | 11.1 | 17.7 | F |
| C-4 | THF | 0.32 | 17.7 | 17.1 | 13.3 | 14.9 | F |
| E-1 | THF | 0.32 | 6.6 | 5.8 | 7.5 | 2.7 | P |
| E-2 | THF | 0.32 | 6.3 | 5.5 | 7.2 | 1.7 | P |
| E-4 | THF | 0.32 | 7.5 | 6.5 | 7.7 | 1.7 | P |
| E-10 | THF | 0.32 | 7.2 | 6.4 | 7.8 | 1.6 | P |
| E-5 | EA | 0.32 | 5.4 | 5.0 | 6.5 | 1.6 | P |
| E-8 | EA | 0.32 | 5.6 | 5.2 | 6.4 | 1.6 | P |
| E-6 | THF | 0.32 | 6.1 | 4.5 | 5.2 | 0.6 | P |
| E-11 | THF | 0.32 | 6.9 | 6.7 | 8.1 | 2.3 | P |
| E-12 | EA | 0.32 | 6.8 | 6.1 | 7.4 | 2.0 | P |

EA = ethyl acetate; THF = tetrahydrofuran)

The above examples indicate that more than 3 wt-% polydimethylsiloxane in the polyimide-siloxane copolymer and a polysiloxane having a molecular weight greater than 3900 are necessary to achieve an acceptable slipping layer according to the invention.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on one side thereof a dye layer and on the other side a slipping layer comprising a lubricating material, the improvement wherein said lubricating material comprises a polyimide-siloxane copolymer, said polysiloxane component comprising more than 3 weight % of said copolymer and said polysiloxane component having a molecular weight of greater than 3900.

2. The element of claim 1 wherein said polyimide-siloxane is derived from a phenylindane diamine, a diaminosiloxane and an aromatic dianhydride.

3. The element of claim 1 wherein said polyimide-siloxane is derived from a toluene diamine, a diaminosiloxane and an aromatic dianhydride.

4. The element of claim 1 wherein said polyimide-siloxane is derived from a 2,2'-bis(amino phenyl)hexafluoropropane, a diaminosiloxane and an aromatic dianhydride.

5. The element of claim 1 wherein said polyimide-siloxane contains recurring units having the structural formula:

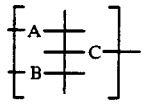

wherein A is selected from a phenylindane radical having the structural formula:

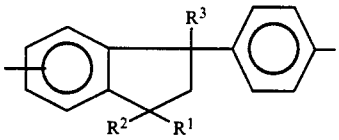

wherein $R^1$, $R^2$, and $R^3$ are individually H or an alkyl group containing from 1 to about 5 carbon atoms; or a group having the structural formula:

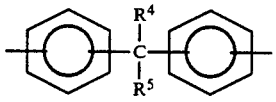

wherein $R^4$ and $R^5$ are individually H, alkyl or fluoroalkyl, the alkyl portion of which contains from 1 to about 5 carbon atoms; or a group having the structural formula:

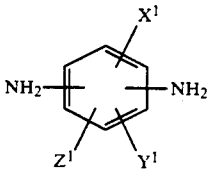

wherein $X^1$, $Y^1$, and $Z^1$ are each independently selected from hydrogen, halogen, alkyl or halogenated alkyl of from 1 to about 12 carbon atoms, or aryl or halogenated aryl of from about 6 to about 12 carbon atoms, provided that all of $X^1$, $Y^1$, and $Z^1$ are not hydrogen;

B has the structural formula:

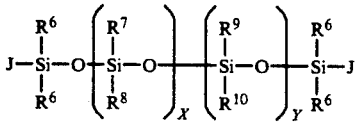

wherein: each J is a linking group independently selected from alkyl and fluoroalkyl groups having up to about 5 carbon atoms, and aryl groups having up to about 12 carbon atoms;

$R^6$, $R^7$, $R^8$, and $R^{10}$ are each individually aryl, alkyl or fluoroalkyl, the alkyl portion of which contains from 1 to 5 carbon atoms; and the values of X and Y are each from 0 to about 400, such that the value of X+Y is from 50 to about 400; and C is a group having the structural formula;

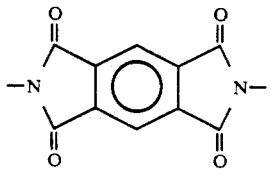

or

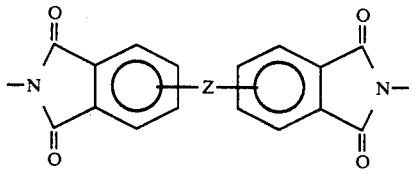

wherein Z is a direct bond,

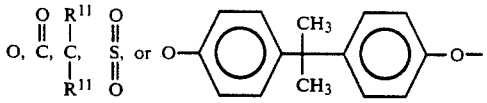

wherein $R^{11}$ is H, alkyl or fluoroalkyl, the alkyl portion of which contains from 1 to 5 carbon atoms.

6. The element of claim 5 wherein J is $-(CH_2)_3-$ or $-(CH_2)_4-$.

7. The element of claim 5 wherein the siloxane monomer is a siloxane dianhydride.

8. The element of claim 7 wherein said organic diamine is 2,4-tolyldiamine, 2,6-tolyldiamine or a mixture thereof.

9. The element of claim 5 wherein J is an aryl group, an alkyl-substituted phenyl radical, or a naphthyl radical.

10. In a process of forming a dye transfer image comprising a dye transfer image comprising:

(a) imagewise-heating a dye-donor element comprising a support having on one side thereof a dye layer and on the other side a slipping layer comprising a lubricating material, and (b) transferring a dye image to a dye receiving element to form said dye transfer image, the improvement wherein said lubricating material comprises a polyimide-siloxane copolymer, said polysiloxane component comprising more than 3 weight % of said copolymer and said polysiloxane component having a molecular weight of greater than 3900.

11. The process of claim 10 wherein said polyimide-siloxane is derived from a phenylindane diamine, a diaminosiloxane and an aromatic dianhydride.

12. The process of claim 10 wherein said polyimide-siloxane is derived from a toluene diamine, a diaminosiloxane and an aromatic dianhydride.

13. The process of claim 10 wherein said polyimide-siloxane is derived from a 2,2'-bis(amino phenyl)hexafluoropropane, a diaminosiloxane and an aromatic dianhydride.

14. The process of claim 10 wherein said polyimide-siloxane contains recurring units having the structural formula:

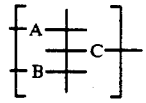

wherein A is selected from a phenylindane radical having the structural formula:

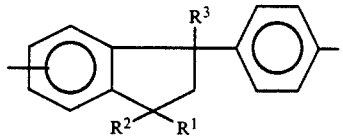

wherein $R^1$, $R^2$, and $R^3$ are individually H or an alkyl group containing from 1 to about 5 carbon atoms; or a group having the structural formula:

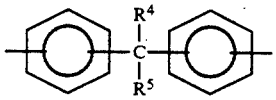

wherein $R^4$ and $R^5$ are individually H, alkyl or fluoroalkyl, the alkyl portions of which contains from 1 to about 5 carbon atoms; or a group having the structural formula:

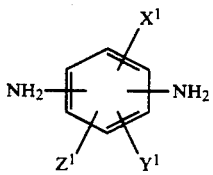

wherein $X^1$, $Y^1$, and $Z^1$ are each independently selected from hydrogen, halogen, alkyl or halogenated alkyl of from 1 to about 12 carbon atoms, or aryl or halogenated aryl of from about 6 to about 12 carbon atoms, provided that all of $X^1$, $Y^1$, and $Z^1$ are not hydrogen.

B has the structural formula:

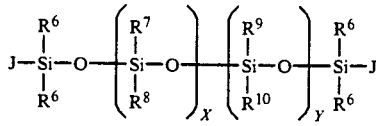

wherein: each J is a linking group independently selected from alkyl and fluoroalkyl groups having up to about 5 carbon atoms, and aryl groups having up to about 12 carbon atoms;

$R^6$, $R^7$, $R^8$, $R^9$, and $R^{10}$ are each individually aryl, alkyl or fluoroalkyl, the alkyl portion of which contains from 1 to 5 carbon atoms; and the values of X and Y are each from 0 to about 400, such that the value of X+Y is from 50 to about 400; and C is a group having the structural formula:

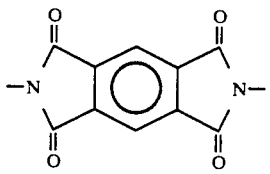

or

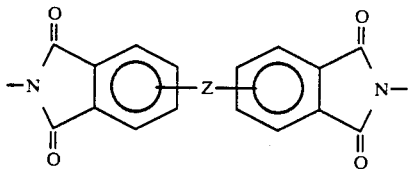

wherein Z is a direct bond,

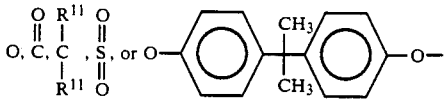

wherein $R^{11}$ is H, alkyl or fluoroalkyl, the alkyl portion of which contains from 1 to 5 carbon atoms.

15. In a thermal dye transfer assemblage comprising (a) a dye-donor element comprising a support having on one side thereof a dye layer and on the other side a slipping layer comprising lubricating material, and (b) a dye receiving element comprising a support having thereon a dye image-receiving layer, said dye-receiving element being in a superposed relationship with said dye-donor element so that said dye layer is in contact with said dye image-receiving layer, the improvement wherein said lubricating material comprises a polyimide-siloxane copolymer, said polysiloxane component comprising more than 3 weight % of said copolymer and said polysiloxane component having a molecular weight of greater than 3900.

16. The assemblage of claim 15 wherein said polyimide-siloxane is derived from a phenylindane diamine, a diaminosiloxane and an aromatic dianhydride.

17. The assemblage of claim 15 wherein said polyimide-siloxane is derived from a toluene diamine, a diaminosiloxane and an aromatic dianhydride.

18. The assemblage of claim 15 wherein said phenyl)-hexafluoropropane, a diaminosiloxane and an aromatic dianhydride.

19. The assemblage of claim 15 wherein said polyimide-siloxane contains recurring units having the structural formula:

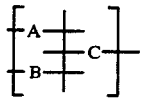

wherein A is selected from a phenylindane radical having the structural formula:

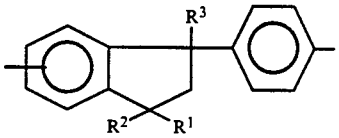

wherein $R^1$, $R^2$, and $R^3$ are individually H or an alkyl group containing from 1 to about 5 carbon atoms; or a group having the structural formula:

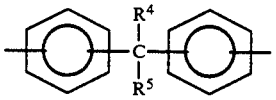

wherein $R^4$ and $R^5$ are individually H, alkyl or fluoroalkyl, the alkyl portion of which contains from 1 to about 5 carbon atoms; or a group having the structural formula:

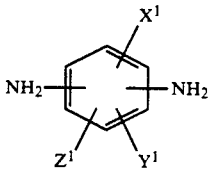

wherein $X^1$, $Y^1$, and $Z^1$ are each independently selected from hydrogen, halogen, alkyl or halogenated alkyl of from 1 to about 12 carbon atoms, or aryl or halogenated aryl of from about 6 to about 12 carbon atoms, provided that all of $X^1$, $Y^1$, and $Z^1$ are not hydrogen.

B has the structural formula:

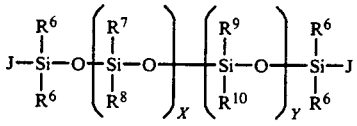

wherein: each J is a linking group independently selected from alkyl and fluoroalkyl groups having up to about 5 carbon atoms, and aryl groups having up to about 12 carbon atoms;

$R^6$, $R^7$, $R^8$, $R^9$, and $R^{10}$ are each individually aryl, alkyl or fluoroalkyl, the alkyl portion of which contains from 1 to 5 carbon atoms; and the values of X and Y are each from 0 to about 400, such that the value of X+Y is from 50 to about 400; and C is a group having the structural formula:
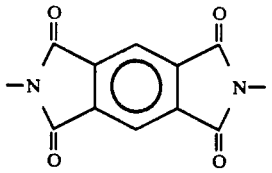
or
-continued
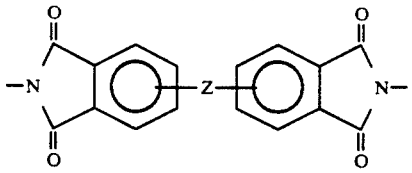
wherein Z is a direct bond,
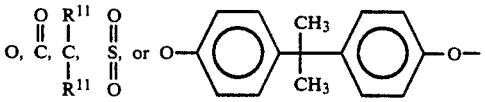
wherein $R^{11}$ is H, alkyl or fluoroalkyl, the alkyl portion of which contains from 1 to 5 carbon atoms.
* * * * *

UNITED STATES PATENT AND TRADEMARK OFFICE

CERTIFICATE OF CORRECTION

PATENT NO. : 5,252,534

DATED : October 12, 1993

INVENTOR(S) : Vito A. DePalma, et al

It is certified that error appears in the above-indentified patent and that said Letters Patent is hereby corrected as shown below:

Column 21, line 19, after "$R^8$," insert --$R^9$--.

Column 24, line 1, after "said" insert --polyimide-siloxane is derived from a 2,2' -bis(amino--.

Signed and Sealed this

Twenty-ninth Day of March, 1994

Bruce Lehman

*Attest:*

BRUCE LEHMAN

*Attesting Officer*

*Commissioner of Patents and Trademarks*